US006001788A

United States Patent [19]

Jaworski et al.

[11] Patent Number: 6,001,788

[45] **Date of Patent: *Dec. 14, 1999**

[54] PERSONAL USE SOAP BAR COMPOSITIONS CONTAINING CATIONIC POLYMERS

[75] Inventors: Robert J. Jaworski; Michael L. Marshall, both of Scottsdale, Ariz.

[73] Assignee: The Dial Corporation, Scottsdale, Ariz.

[ * ] Notice: This patent issued on a continued prosecution application filed under 37 CFR 1.53(d), and is subject to the twenty year patent term provisions of 35 U.S.C. 154(a)(2).

[21] Appl. No.: 08/779,656

[22] Filed: Jan. 6, 1997

Related U.S. Application Data

[60] Provisional application No. 60/009,895, Jan. 11, 1996.

[51] Int. Cl.[6] ..... C11D 1/02; C11D 9/60; C11D 3/22

[52] U.S. Cl. ..... 510/151; 510/147; 510/152; 510/153; 510/454; 510/475; 510/483; 510/491

[58] Field of Search ..... 510/151, 152, 510/153, 147, 454, 475, 491, 483; 252/367.1

[56] References Cited

U.S. PATENT DOCUMENTS

| | | | |
|---|---|---|---|
| 4,946,618 | 8/1990 | Knochel et al. | 252/117 |
| 4,985,170 | 1/1991 | Dawson et al. | 252/117 |
| 5,202,048 | 4/1993 | Bontolo et al. | 252/117 |
| 5,296,159 | 3/1994 | Wilson et al. | 252/117 |

FOREIGN PATENT DOCUMENTS

| | | | |
|---|---|---|---|
| 0459769 | 12/1991 | European Pat. Off. | C11D 3/20 |

*Primary Examiner*—Yogendra Gupta
*Assistant Examiner*—Gregory E Webb
*Attorney, Agent, or Firm*—Richard G. Harrer

[57] ABSTRACT

A personal use soap bar composition containing alkali metal soaps of fatty acids having alkyl chain lengths of $C_8$–$C_{22}$ which include an unhydrated cationic guar gum polymer as a skin feel and mildness additive. Prior to incorporating the polymer into the soap, it is mixed with an anhydrous polyglycol ether such as PEG-6 methyl ether. This eliminates the need to hydrate the cationic polymers to achieve uniform distribution of the polymer in the bar.

7 Claims, No Drawings

PERSONAL USE SOAP BAR COMPOSITIONS CONTAINING CATIONIC POLYMERS

This application claims the benefit under Title 35 U.S.C. 119(e) of U.S. Provisional Application No. 60/009,895 filed Jan. 11, 1996.

This invention relates to personal use soap bar compositions containing cationic polymers as skin benefiting agents.

BACKGROUND OF THE INVENTION

For a considerable number of years, polymers of various types have been incorporated into a variety of cleaning and personal use cleansing compositions for a variety of purposes. For example, polymers are used in powdered laundry detergents as production assistance, builder assistance, and anti-redeposition agents. In liquid laundry products, they are used as thickeners, and in automatic dishwasher liquids as builders and softeners and as thickeners; in dry dishwasher formulations as builders and softeners.

In the field of personal use skin cleansing compositions, ideally such compositions should be both mild to the skin and give the user's skin a desirable smooth and slippery feel. It is known to incorporate cationic polymers into cleansing bar compositions to effect skin conditioning. In U.S. Pat. No. 5,064,555 and its related U.S. Pat. No. 4,820,447, there is disclosed skin cleansing soap bars comprising soap and a hydrated cationic guar-gum polymer, the addition of which is said to improve the mildness of the soap bar. According to the patents, the soap bars incorporate a hydrated cationic polymer having a molecular weight of from about 1000 to about 3,000,000 with it being preferred that such polymer be a cationic guar-gum polymer having a molecular weight in the range of 2500–350,000. The inventors state it is essential that the cationic polymer be hydrated to achieve uniform distribution of the polymer in the bar. It is further stated that the preferred cationic polymers are of the cationic guar-gum class, examples being JAGUAR C-14-S, C-15 and C-17 previously available from Celanese Corporation and now available from Rhone-Poulenc, inc. It is further disclosed that the polymers require a relatively large amount of water for their hydration. As an example, for JAGUAR C-15 the ratio of polymer to water is about 9 to 1; for JAGUAR C-14S, the ratio is about 19 to 1. From a reading of the patents, it is clear that hydrating the cationic polymer is most important to a successful use of such polymer in a bar soap product. It is also clear that the need to hydrate the polymer is not only an extra step in the soap making process, but requires additional energy to dry the soap to its appropriate moisture level because of the incorporation of the additional water.

It would therefore be a surprising advance in the soap-making art to provide a process for incorporating cationic polymers of the type disclosed in the aforementioned patents and particularly to incorporate cationic guar-gum polymers in soap compositions without the need to hydrate the polymer either prior to or during the soap-making process. It would also be an important advance that the incorporation of such so-called "dry" polymers be accomplished with very little or no gritty feeling to the bar compositions. In short, it would be an important advance to obtain the benefits of the use of cationic guar-gum polymers in bar products as disclosed in the aforementioned patents, without the need to hydrate the polymers.

SUMMARY OF THE INVENTION

It has been discovered that cationic guar-gum polymers can be incorporated into personal use soap bar compositions without the need to hydrate the polymer either prior to or during the preparation of the bar product. Such soap compositions can contain up to about 90% by weight of soap and from about 0.2% by weight to about 5% by weight of the unhydrated cationic guar-gum polymer, preferably about 0.5% by weight to about 2.0% by weight. Prior to incorporating the polymer into the soap, it is mixed with a polyethylene or polypropylene glycol linear polymer, preferably a polyglycol ether, such as PEG-6 methyl ether, and the anhydrous polymer/glycol mixture is then incorporated into the soap mass. PEG-6 methyl ether is polyethylene glycol 6 methyl ether and is of the formula: $CH_3OCH_2CH_2)_6OH$. Any small amount of gritty feeling that may be present in the bar composition can be virtually eliminated by the addition of a superfatting agent, such as free fatty acid, to the soap mass, and, depending on the particular type of cationic guar-gum polymer used, by the further addition of polyhydric alcohol and/or milling of the soap mass.

DETAILED DESCRIPTION OF THE INVENTION

This discovery relates to personal use soap bar compositions which incorporate from about 0.2% by weight to bout 5.0% by weight of an unhydrated cationic guar-gum polymer as a skin feel and mildness additive. Prior to incorporating the polymer into the soap, it is mixed with an anhydrous polyethylene glycol linear polymer such as an anhydrous polyglycol ether, more specifically PEG-6 methyl ether. After mixing, the polymer/glycol mixture is then thoroughly mixed with the soap mass. To effect maximum smoothness of the bar, a minor amount of from about 1.0% by weight to about 10.0% by weight of a superfatting agent such as free fatty acid should be present in the soap. Preferably, about 2.0% by weight to about 5.0% by weight is used. Depending on the particular type of cationic guar-gum polymer employed, maximum smoothness of the bar and virtually no gritty feel may be obtained through the addition of a polyhydric alcohol and/or special milling of the soap.

The soaps used are the well-known alkali metal soaps of fatty acids having alkyl chain lengths of $C_8$–$C_{22}$, preferably $C_{12}$–$C_{18}$. For example, sodium tallowate, sodium palm kernalate or sodium cocoate and mixtures thereof perform very well. The fatty acid soaps can be present in amounts up to about 90% by weight of the composition, more preferably in the range of 60–80% by weight and most preferably in the range of 65–70% by weight. A preferred soap is a mixture of sodium tallowate and sodium cocoate at a ratio of 80:20 or 70:30.

Although a variety of cationic polymeric skin conditioning agents may be employed, we prefer the cationic guar-gums having molecular weights of from about 1 to about 1.7. Such polymers are available from Rhone-Poulenc, Inc. and designated as Jaguar C-14S, Jaguar C-15S and Jaguar C-17S, which are the single derivative (quaternized) polymers. We prefer to employ a polymer designated Jaguar C-162 and also available from Rhone-Poulenc. Jaguar C-162 also belongs to the family of quaternized guar-gums. Jaguar C-162 is distinguished from the other members of this family in that it has been "double derivatized". The guar backbone is first derivatized with propylene oxide to form hydroxypropyl groups. Then the polymer is quaternized which results in either formation of an ether linkage with a free hydroxy group on the guar backbone or an ether linkage with the free hydroxy group on the hydroxypropyl moiety. The purpose of the inclusion of the hydroxypropyl functionality is to increase polymer solubility in water. Polymers of this type typically contain insoluble impurities such as protein and lower chained galactose particles. Hydroxypropylation also derivatizes these impurities improving their solubility in water. Thus, Jaguar C-162 is a double derivative of guar containing both cationic groups and hydroxypropyl groups. The degree of substitution for the cationic group is approximately 0.1 which means there is 1 cationic group, on average, per 10 galactose/mannose sugar groups. The molecular substitution for the hydroxypropyl group is about 0.5 to about 0.6 equivalent to, on average, 1 hydroxypropyl group per 2 galactose/mannose sugar groups. All the foregoing polymers are water soluble with Jaguar C-162 being about ⅔ the molecular weight of C-14S. As measured by viscosity:

C-14S measures 3–4,000 cps for a 1% solution

C-162 measures 300–100 cps for a 1% solution

A preferred composition of this invention also contains from about 1.0% by weight to about 10.0% by weight of a superfatting agent such as a free fatty acid (alkyl $C_{12}$–$C_{18}$) such as coconut fatty acid to improve the smoothness, reduce drag and give a grit free feel to the bar. It is also possible to employ oils such as coconut oil, palm kernel oil and basassu oil as the super fatting agent, either alone or in combination with the free fatty acids.

We have also found that the addition of a polyhydric alcohol can improve the smoothness and grit free feel of the composition, particularly where Jaguar C-14S, C-15S or C-17S polymers are employed. Such polyhydric alcohols have 2 or more hydroxyl groups, preferably from 3 to 6 hydroxyl groups, and include such alcohols as glycerol, sorbitol, mannitol, erythritol, with sorbitol being preferred. The amount of such alcohol to be included ranges from about 1.0% by weight to about 12.0% by weight with about 4.0% by weight to about 10.0% by weight being preferred. When Jaguar C-16S polymer is employed, the polyhydric alcohol is not needed, although it certainly does not detract from the quality of the bar.

Another surprising quality of this invention is that the unhydrated cationic guar-gum polymer can be incorporated into a translucent soap bar without adversely affecting the clarity of the bar. In this aspect of the invention, it is important that no free water be present during the mixing of the polymer with the polyglycol ether or even when the polyglycol ether/polymer mixture is added to the soap. The presence of water will tend to adversely effect the translucency of the bar. To aid in the translucency of the bar, we incorporate known translucency promoting agents such as glycerin in an amount of about 1.0% by weight to about 8.0% by weight of the composition.

In preparing the personal cleansing bars of this invention, generally speaking, processes common to the production of conventional soap bars are employed with, of course, certain exceptions. The alkali metal soap is preferably used in pellet form and such soap pellets can consist, for example, of an 80/20 or 70/30 blend of sodium tallowate and sodium cocoate with the moisture level of the pellets ranging from about 10.5% by weight to about 18.0% by weight. About 12.0% by weight to 15.0% by weight of moisture is preferred.

The unhydrated cationic polymer can be mixed with the polyethylene glycol ether using suitable mixing equipment to form a slurry. The ratio of cationic guar-gum to the glycol ether ranges from about 1 part of polymer to 1 part of said ether to about 1 part of polymer to about 4 parts of glycol ether with a ratio of about 1 to about 1.5 being preferred. The polymer/glycol ether slurry appears to be a colloidal suspension of the polymer in the glycol ether. After mixing is complete, the slurry and soap pellets are put into an amalgamator along with any fragrance, and, if not previously incorporated into the pellets, a suitable amount of super fatting agent. After thorough mixing in the amalgamator, the soap mass is sent to a multiple roll mill and then to a plodder where sorbitol, if used, can then be added. The soap can be plodded through a single screen or multiple screens, then extruded, formed into slugs and then stamped.

EXAMPLE I

Antibacterial, translucent soap bars of the following composition were prepared:

| Ingredient | Weight % |
|---|---|
| Soap (sodium tallowate & sodium cocoate 70:30) | 67.0 |
| Water | 15.8 |
| Glycerin | 7.1 |
| Free fatty acids | 1.8 |
| PEG-6 methyl ether | 1.50 |
| Fragrance | 1.50 |
| Preservatives | 0.30 |
| Jaguar C-162 | 1.0 |
| Sorbitol | 1.1 |
| Triclocarbon | 0.3 |
| Dyes/Colors | 0.001 |

Soap pellets (70:30 ratio sodium tallowate/sodium cocoate) were prepared having about 2.0% by weight of superfatting agent (coconut oil), 7.6% glycerin and about 17.0% by weight of moisture.

A slurry of about 35.7% of Jaguar C-162, 53% of PEG-6 methyl ether, 11.0% Triclocarban and dyes was prepared using suitable mixing equipment.

Thereafter, the soap pellets and slurry were sent to an amalgamator along with fragrance and mixed for 2–3 minutes.

Following mixing in the amalgamator, the soap mass was sent through a multiple roll mill and then to a multi-stage plodder with 10 mesh screens mounted on the end of each plodder. A portion of the sorbitol was added to the soap between plodders. Thereafter, the soap was sent to another multi-stage plodder with the remaining amount of sorbitol added to the soap prior to the final plodding step. Following plodding, the soap was extruded, cut and formed into bars.

EXAMPLE II

Soap bars prepared in accordance with EXAMPLE I were graded for bar feel according to the following scale:

BAR FEEL GRADING SCALE

| | DRAG | GRIT |
|---|---|---|
| 10 | Perfectly smooth and slippery | no specks |
| 9 | Practically smooth or | one speck |
| 8 | Barely detectable sandiness, roughness, draginess | 2–3 specks |
| 7 | Slight sandiness, roughness, draginess | 4–5 specks |
| 6 | Moderate overall sandiness, roughness, draginess | 6–10 specks |
| 5 | Quite noticeable overall sandiness, roughness | 10–20 specks |
| 4 | Pronounced overall sandiness or roughness | >20 specks |
| 3 | Pronounced overall coarse sandiness or roughness | — |
| 2 | Extreme overall course sandiness or roughness | — |
| 1 | Extreme overall abrasive roughness | — |

A bar is graded according to the foregoing scale in which a grade of "10" indicates that the bar is perfectly smooth and slippery and has no specks of grit.

A skilled operator runs the grading test. Water at 70° F. is constantly run into a basin in a manner such that the water temperature is kept at a constant 70° F. The operator takes the sample bar in his/her hands, and washes with the bar while keeping the bar submerged in the 70° F. water. The bar is rotated in the operator's hands about 60 to 70 times per minute. After about 15 seconds, the operator begins the grading, and this is continued for about one minute. A final grade is then given to the bar.

The bars produced in accordance with Example I were grade "10" indicating that the bars were perfectly smooth and free of grit.

We claim:

1. A method for preparing a personal use soap bar composition incorporating an unhydrated cationic quaternized guar gum polymer as a mildness enhancing agent, comprising the steps of forming an alkali metal soap of fatty acids having alkyl chain lengths of from about 8–22 carbon atoms, said soap containing a superfatting agent and a polyhydric alcohol having from 2 or more hydroxyl groups; separately preparing an anhydrous slurry containing a cationic quaternized guar gum polymer having a molecular weight from about 2500 to about 350,000 and a polyethylene or polypropylene glycol linear polymer; thereafter mixing said soap and anhydrous slurry to achieve uniform distribution of said slurry in said soap, and thereafter milling and plodding said soap; said soap comprising from about 60% to about 90% by weight of said composition, said cationic quaternized guar gum polymer comprising from about 0.2% to about 5.0% by weight of said composition, and wherein the amount of polyethylene or polypropylene glycol linear polymer ranges from about 1 part to each 1 part of cationic polymer to about 4 parts to each 1 part of cationic polymer.

2. The method of claim 1 wherein said cationic quaternized guar gum polymer has an extent of quaternization of from about 1 to about 1.7 and is a single derivative polymer and wherein said polyhtdric alcohol has from about 3 to about 6 hydorxyl groups.

3. The method of claim 1 wherein said cationic quaternized polymer is a double derivatized polymer.

4. The method of claim 3 wherein said soap bar is translucent and contains from about 1% to about 8% by weight of glycerin.

5. The method of claim 4 wherein said glycerin is present in an amount of from about 4.0% to about 8.0% by weight of said composition.

6. The method of claim 5 wherein said slurry contains sufficient polymer and polyglycol ether so that the resulting soap bar contains about 1% by weight of said polymer and from about 1.0% to about 2.0% by weight of said polyglycol ether.

7. The method of claim 6 wherein said polyglycol ether is PEG-6 methyl ether.

* * * * *